United States Patent [19]

Lekhtman

[11] Patent Number: 4,844,501

[45] Date of Patent: Jul. 4, 1989

[54] CROSS-COUNTRY SKI CLIMBING DEVICE

[76] Inventor: David Lekhtman, 324 Rt. 329, Morin Heights, Quebec, Canada, JOR 1HO

[21] Appl. No.: 171,577

[22] Filed: Mar. 22, 1988

[51] Int. Cl.[4] ..... A63C 7/10

[52] U.S. Cl. ..... 280/605

[58] Field of Search ..... 280/604, 605; 188/5

[56] References Cited

U.S. PATENT DOCUMENTS

| | | | |
|---|---|---|---|
| 1,401,940 | 12/1921 | Beckman . | |
| 1,665,537 | 4/1928 | Dumais . | |
| 2,077,660 | 4/1937 | Barieau . | |
| 2,107,363 | 2/1938 | Binder . | |
| 2,122,718 | 7/1938 | Hikel . | |
| 2,199,721 | 5/1940 | Coffin . | |
| 2,232,443 | 2/1941 | Farmer . | |
| 2,316,252 | 4/1943 | Karlsson . | |
| 2,375,943 | 5/1945 | Rape . | |
| 3,741,575 | 6/1973 | Bortoli | 280/605 |

FOREIGN PATENT DOCUMENTS

| | | | |
|---|---|---|---|
| 144581 | 2/1936 | Austria | 280/605 |
| 559386 | 9/1932 | Fed. Rep. of Germany | 280/604 |
| 1010468 | 6/1952 | France | 280/605 |
| 376111 | 10/1939 | Italy | 280/605 |
| 377777 | 1/1940 | Italy | 280/605 |
| 31655 | 1/1921 | Norway | 280/605 |
| 95741 | 5/1939 | Sweden | 280/605 |

*Primary Examiner*—Charles A. Marmor
*Assistant Examiner*—Michael Mar
*Attorney, Agent, or Firm*—Fishman, Dionne & Cantor

[57] ABSTRACT

To arrest backward sliding of a cross-country ski on an inclined surface, a device is attached to the cross-country ski. The device includes a mounting block mounted on the top surface of the ski such that a first side of the mounting block is adjacent an edge of the ski. A flipper member is pivotally connected to the first side of the mounting block such that, in a vertical position of the flipper member, the flipper member overlies the one edge of the ski. The flipper member includes a first wall substantially parallel with the one edge of the ski, and a second wall substantially perpendicular to the first wall. Thus, sliding of the ski is arrested both in the direction along the longitudinal axis of the ski and in the direction transverse to the longitudinal axis.

7 Claims, 1 Drawing Sheet

CROSS-COUNTRY SKI CLIMBING DEVICE

BACKGROUND OF INVENTION

1. Field of the Invention

The invention relates to a device for attachment to a cross-country ski to arrest backward sliding of the ski on an inclined surface. More specifically, the invention relates to such a device which is self-cleaning.

2. Description of Prior Art

It is known in the art to provide means for arresting backward sliding of cross-country skis. One example of such a device is illustrated in U.S. Pat. 1,401,940, Beckman, Dec. 27, 1921. The Beckman patent teaches a pivoting arm 1 with means to limit the upward and downward swinging movements of the arm 1. The end of the arm has a sharp point which is dangerous as persons waxing the ski could quite easily cut themselves. In addition, snow can gather in the device and freeze to ice causing a cessation of the operation of the Beckman device.

A further arrangement is illustrated in U.S. Pat. No. 1,665,537, Dumais, April 10, 1928. In the Dumais patent, tines 23 are mounted to pivot freely on the ski. The tines extend on either side of the ski. The tines of the Dumais arrangement have the same disadvantages as the arm of the Beckman arrangement in that they are dangerous and are subject to freezing over.

U.S. Pat. No. 2,077,660, Barieau, April 20, 1937 and U.S. Pat. No. 2,107,363, Binder, Feb. 8, 1938, both teach cleats for climbing hills. The cleats do not operate automatically but have to be manually moved from an operating to a nonoperating position and vice-versa.

U.S. Pat. No. 2,122,718, Hikel, July 5, 1938 teaches an extension 24 which overhangs one edge of the ski and is spring-biassed downwardly. When a skier moves in the forward direction, the extension 24 will be dragged along the ground by overcoming the bias of the spring. When the ski attempts to exhibit backward motion, the extension 24 will extend downwardly and stick into the ground to prevent this backward motion. The Hikel device is also subject to freezing up.

U.S. Pat No. 2,232,443, Farmer, Feb. 18, 1941 teaches freely pivoted tongues 33 extending on both sides of the ski with means for limiting the movement of the tongues. This arrangement is also subject to freezing up.

U.S. Pat. No. 2,199,721, Coffin, May 7, 1940 teaches a freely pivoted dog 1 which extends on one side of the ski. The dog is fixed to the ski with a clamp to easily mount or remove the dog from the ski. This arrangement is also subject to freezing.

U.S. Pat. No. 2,316,252, Karlsson, April 13, 1943 teaches spring-biassed blades 13 extending on either side of the ski. The blades are biassed downwardly so that the arrangement works similar to the manner in which the Hikel device, referred to above, works. This arrangement is also subject to freezing up.

U.S. Pat. No. 2,375,943, Rape, May 15, 1945 teaches the use of climbing blades 1 which have to be manually removed and mounted.

In all of the above arrangements, as the means which stick into the ground are basically in a single plane, they will arrest motion in one direction only, namely, in the longitudinal direction of the ski. They will not arrest motion in the lateral direction of the ski.

SUMMARY OF INVENTION

It is an object of the invention to provide a device for mounting on cross-country skis which overcomes the disadvantages of the prior art.

It is a more specific object of the invention to provide such a device which is not subject to freezing up.

It is an even more specific object of the invention to provide such a device which is self-cleaning whereby it is not subject to freezing up.

It is an even more specific object of the invention to provide such a device which arrests motion in two directions, namely, in the longitudinal direction of the ski and in the direction perpendicular to the longitudinal direction.

In accordance with the invention there is provided a device for attachment to a cross-country ski to arrest backward sliding of the ski. The device includes a mounting block mounted on the top surface of the ski such that a first side of the mounting block is adjacent an edge of the ski. A flipper member is pivotally connected to the first side of the mounting block such that, in a vertical position of the flipper member, the flipper member overlies the one edge of the ski. The flipper member includes a first wall substantially parallel with the one edge of the ski, and a second wall substantially perpendicular to the first wall. Thus, sliding of the ski is arrested both in the direction along the longitudinal axis of the ski and in the direction transverse to the longitudinal axis.

BRIEF DESCRIPTION OF THE DRAWINGS

The invention will be better understood by an examination of the following description, together with the accompanying drawings, in which.

DESCRIPTION OF PREFERRED EMBODIMENTS

Figure 1:
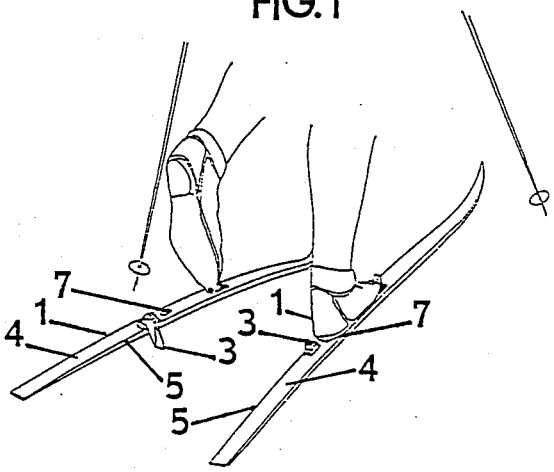
FIG. 1 illustrates a pair of cross-country skis, being worn by a skier, and with the inventive devices attached thereto.

Referring to the drawings, skis 1 have the inventive device 3 mounted on the top surface 4 of the skis at the inner edge 5 thereof. The device is mounted behind the heel 7 of the skier, i.e., at or close to the center of gravity of the ski.

Figure 2:
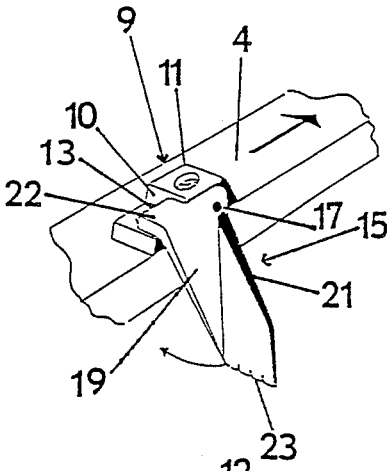
FIG. 2 is a more detailed view of the device in one position of the flipper member thereof.
Figure 3:
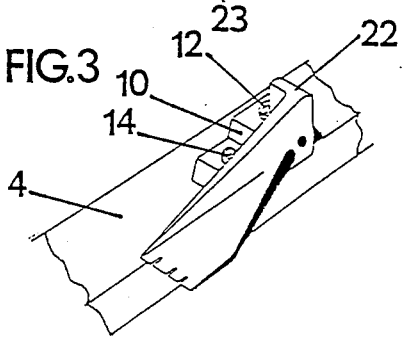
FIG. 3 is a view similar to the view of FIG. 2 but with the flipper member in a different position.

Turning to FIGS. 2 and 3, the inventive device comprises a mounting block 9 having a top surface with an upper level 11 and a lower level 13. The upper and lower levels are joined by an upright side 10. The mounting block 9 is fastened to the top surface of the ski by screw 12, at the upper level, and screw 14, at the lower level. Pivotally attached to the mounting block is a flipper member 15. The flipper member 15 is pivotally attached to the mounting block by a pivot pin 17.

The flipper member comprises a first wall 19, which extends substantially parallel to edge 5 of the ski, and a second wall 21 which extends substantially perpendicular to the first wall 19. Formed integrally with the first wall 19 and extending at substantially right angles thereto is a stop means 22. Disposed at the bottom edge of the second wall are teeth 23.

As can be seen in the drawings, the first wall has a downward taper in both width and thickness. The second wall has an upward taper in width and a downward taper in thickness. The downward taper thickness of the second wall is not sufficient to provide a cutting edge at the bottom. For this reason, teeth 23 are provided to permit the lower edge of the second wall to break through hard crusted snow or ice. However, the danger of a cutting edge is avoided with this expedient.

Figure 4:
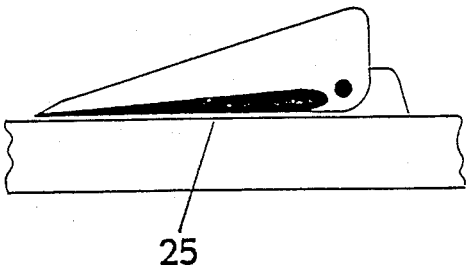
FIG. 4 is a side view of FIG. 3.

As seen in FIG. 4, the bottom surface 25 of the flipper member is stream-lined in shape.

In operation, the device works as follows:

When the ski is moving forwardly, the flipper member will be forced into the horizontal position as shown in FIG. 3. Because the bottom surface of the flipper member is stream-lined, the flipper member will slide along the top surface of the snow instead of being dragged. Thus, the flipper member will not impede motion in the forward direction.

As the skier lifts his feet, the flipper member will fall down to the vertical position shown in FIG. 2, and, when the ski slides along the ground again, the forward motion will force the flipper member into the position in FIG. 3. Thus, with each step, the edge of the stopper member 22 adjacent the upright wall 10 will hammer on the upper level 11 of the mounting block 9. This hammering will shake loose any moisture or snow which is on the flipper member to cleanse the flipper member of snow or moisture and thereby avoid freezing up of the device. Thus, the device is self-cleansing in operation.

To permit easy movement of the flipper member, there is a clearance between the edge of the stop means adjacent the wall 10 and the wall 10.

When the edge of the stop means adjacent the wall 10 makes contact with the upper level 11, any further upward movement of the flipper member is arrested. Thus, this edge of the stop means serves to stop the movement of the flipper member in one direction.

When the bottom surface of the stop means makes contact with the lower level 13, any further downward movement of the flipper member is arrested. Thus, the stop means serves to arrest motion in the other direction as well.

When the ski attempts to slide in the backward direction, the flipper member will be disposed vertically downward as shown in FIG. 2 and will bite into the snow or ice to thereby arrest any further backward slipping. Second wall 21 arrests motion in the longitudinal direction of the ski, while first wall 19 arrests motion in a transverse direction.

It can therefore be seen that the disadvantages of the prior art have been overcome, and the objectives of the invention have been attained.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A device for attachment to a cross-country ski to arrest backward sliding of said ski on an inclined surface, comprising:

a mounting block mounted on the top surface of said ski such that a first side of said mounting block is adjacent an edge of said ski;

a flipper member pivotally connected to said first side of said mounting block such that, in a vertical position of said flipper member, said flipper member overlies said one edge of said ski;

said flipper member comprising a first wall substantially parallel with said one edge of said ski and a second wall substantially perpendicular to said first wall;

whereby to arrest sliding of the ski both in the direction along the longitudinal axis of the ski and the direction transverse to the longitudinal axis;

said mounting block having a top surface having an upper level and a lower level and an upright wall joining said lower level to said upper level;

and further including stop means for said flipper member comprising an extension of the upper end of said first wall formed integrally with said first wall and bent at an angle thereto and having one edge adjacent said upright wall;

a clearance gap between said one edge of said flipper member and said upright wall;

whereby, said flipper member will be stopped in its downward motion by said stop means overlying said lower level; and said flipper member will be stopped in its upper motion by said one edge of said stop means making contact with said upper level.

2. A device as defined in claim 1 wherein said first wall has a downward taper in both width and thickness.

3. A device as defined in claim 1 wherein said second wall has an upward taper in width and a downward taper in thickness.

4. A device as defined in claim 3 and including teeth at the bottom edge of said second wall.

5. A device as defined in claim 1 wherein said angle is 90°;

whereby, said flipper member will stopped in its downward motion when it reaches a vertical position; and said flipper member will be stopped in its upward motion when it reaches a horizontal position.

6. A device as defined in claim 1 wherein said lower surface of said flipper member is aerodynamically shaped.

7. A device as defined in claim 1 wherein said one edge of said ski is the inner edge of said ski.

* * * * *